US005445717A

United States Patent [19]

Kärki et al.

[11] Patent Number: 5,445,717

[45] Date of Patent: Aug. 29, 1995

[54] METHOD FOR SIMULTANEOUS PRODUCTION OF ALKALI METAL OR AMMONIUM PEROXODISULPHATE SALTS AND ALKALI METAL HYDROXIDE

[75] Inventors: Ari M. O. Kärki; Matti J. Lindström, both of Lappeenranta; Heikki T. Pajaril, Helsinki, all of Finland

[73] Assignee: Kemira Oy, Espoo, Finland

[21] Appl. No.: 287,139

[22] Filed: Aug. 8, 1994

[30] Foreign Application Priority Data

Aug. 17, 1993 [FI] Finland ..... 933623

[51] Int. Cl.[6] ..... C25B 1/28; C25B 1/16

[52] U.S. Cl. ..... 204/82; 204/92; 204/93; 204/98

[58] Field of Search ..... 204/82, 83, 92, 93, 204/98

[56] References Cited

U.S. PATENT DOCUMENTS

| | | | |
|---|---|---|---|
| 3,884,778 | 5/1975 | Eng et al. | 204/84 |
| 4,144,144 | 3/1979 | Radimer | 204/82 |
| 4,310,394 | 1/1982 | Malafosse et al. | 204/82 |
| 4,802,959 | 2/1989 | Lipsztajn | 204/82 |
| 5,089,252 | 2/1992 | Grollier et al. | 424/47 |
| 5,098,532 | 3/1992 | Thompson | 204/98 |

*Primary Examiner*—John Niebling
*Assistant Examiner*—Brendan Mee
*Attorney, Agent, or Firm*—Tilton, Fallon, Lungmus & Chestnut

[57] ABSTRACT

The present invention relates to a method for simultaneous continuous-action production of alkali metal or ammonium peroxodisulphate salts and alkali metal hydroxide. The electrolytic phase of the method is performed in a three-space electrolytic cell (1), into the middle space (3) whereof alkali metal sulphate is conducted, into the anode space (4), ammonium or alkali-metal sulphate, or a mixture thereof is conducted, and into the cathode space (2), water or diluted alkali metal hydroxide is conducted. Direct current is conducted through the electrolytic cell (1), whereby the sulphate ions pass into the anode space (4) and are oxidized into peroxodisulphate ions, thus producing alkali metal or ammonium peroxodisulphate, which is transformed into saline form in a fashion known in itself in the art, and the alkali metal ions pass into the cathode space (2) and form alkali metal hydroxide.

12 Claims, 1 Drawing Sheet

METHOD FOR SIMULTANEOUS PRODUCTION OF ALKALI METAL OR AMMONIUM PEROXODISULPHATE SALTS AND ALKALI METAL HYDROXIDE

SUMMARY OF INVENTION AND BACKGROUND DESCRIPTION OF THE ART

The present invention relates to simultaneous production of alkali metal or ammonium peroxodisulphate salts and alkali metal hydroxide using a continuous-action electrochemical process, in the electrolytic phase whereof alkali metal sulphate is electrodialysed in a three-space electrolytic cell divided by an anion and cation exchange membrane.

The main products obtained with the method of the present invention, that is, inorganic peroxodisulphate compounds, are powerful oxidizers, as is well known in the art, but far more specific compared, for instance, with hydrogen peroxide. They are used, inter alia, for purifying metals and etching, and as initiators in polymerizing reactions. The commercial production of peroxodisulphate salts takes place exclusively by means of electrolysis.

The overall reaction of the electrolytic phase of the electrochemical production processes of alkali or ammonium peroxodisulphates known in the art, consisting of oxidation of sulphate ions with anode and from the hydrogen development reaction by means of a cathode, may be presented in the following form:

$$M_2SO_4+H_2SO_4 \rightarrow M_2S_2O_8+H_2$$

where M is an alkali metal ion or an ammonium ion. Subsequent to the electrolysis, the anolyte and the catholyte are partly combined. From the solution thus obtained peroxodisulphate salt is obtained as a product by means of crystallisation. The electrolysis is typically performed in a two-space cell in which the anode and cathode spaces have been separated by a porous membrane or diaphragm. The function of the porous membrane is to avoid the travelling of the peroxodisulphate ion produced in the anode to the cathode by preventing the solutions in the anode and the cathode space from being mixed mechanically.

The significance of the other main products of the process according to the present invention, the alkali metal hydroxides, the production of sodium hydroxide of which is clearly greatest in volume, is great in the chemical and wood-processing industries. Today, nearly all commercially produced lye is produced electrochemically by a chloride—alkali process, the total reaction of the electrolytic phase whereof being as follows:

$$2NaCl+2H_2O \rightarrow Cl_2+2NaOH+H_2$$

Because of the decreasing demand of chloride, it is important to develop new substitutive electrochemical or chemical production methods for lye.

From the point of view of the economical factors related to electrochemical syntheses, it is often essential that commercially utilizable produces are produced in both electrode reactions. In such instances, cell structures are usually used in which the solutions in the anode space and in the cathode space and in a potential supply space of the cell are separated from one another. The partial separation of the spaces was earlier performed merely by means of porous diaphragms inhibiting merely mechanical admixing, whereas the spaces are nowadays most often separated with the aid of ion exchange membranes affecting selectively the travelling of the ions.

As an example of the use of ion exchange membranes in producing peroxodisulphate salts, U.S. Pat. No. 4,310,394 may be mentioned, in which a cation exchange membrane is used in a two-space electrolytic cell. With the aid of a cation membrane the travelling of peroxodisulphate ions to the cathode can be prevented more effectively than with a porous diaphragm typically used.

Along with the development of ion exchange membranes the regeneration of sodium sulphate, and therethrough also of other alkali metal sulphate salts has become state of art technology by the use of combined electrolysis and electrodialysis in a three-space cell, where the middle space has been separated from the anode space with an anion exchange membrane and the cathode space from the middle space with a cation exchange membrane. Typically in such process, sodium sulphate solution is supplied into the middle space, and the products, typically sulphuric acid and lye, can be recovered from the anode space and the cathode space. While conducting direct current through a cell such as described above, the sodium ions fed into the middle space move through the cation exchange membrane into the cathode space and the sulphate ions through the anion exchange membrane into the anode space.

The method and the electrolytic cell described above have been applied in producing lye and sulphuric acid, for instance, in the FI patent application No. 911401. Using the process described in said application, about 27% lye and 40% sulphuric acid can be produced at 80% current efficiency when the thermal energy developed in the course of the electrolysis is utilized in evaporating the water in a vacuum evaporator. The electrolytic cell operates preferably in the range from +70° to +150° C.

U.S. Pat. No. 5,089,532 discloses a method in which lye and ammonium sulphate are produced in a three-space electrolytic cell divided with anion and cation exchange membranes. In the method, ammonia is supplied into an anode space solution. The ammonia neutralizes the hydrogen ions formed with the anode in association with the oxygen development reaction, and as a product from the anode space, ammonium sulphate is obtained instead of sulphuric acid.

U.S. Pat. No. 3,884,778 discloses a method for producing lye and hydrogen peroxide by electrodialyzing sodium sulphate in a three-space cell with a solution of sulphuric acid and persulphuric acid as the anolyte. Hydrogen peroxide can be prepared by hydrolysing persulphuric acid produced in the anode space. According to said patent, the concentration of the sulphuric acid in the anolyte is typically over 80%.

In electrolyses in which sulphuric acid is prepared in the anode space of a three-space cell described above the problem is typically the dilutedness of the product acid. This is due to the fact the anion exchange membranes currently produced are capable of retaining efficiently the hydrogen ions in the anode space merely at relatively low concentrations. As regards the other cations, the anion exchange membranes act far more successfully. Along with increasing sulphuric acid concentration, the hydrogen ions pass through the anion exchange membrane into the middle part of the cell, and from there onwards into the cathode space, whereby the current efficiencies related both to production of sulphuric acid and production of lye will be low in a continuous-action electrolysis.

By neutralizing with ammonia the hydrogen ions produced in oxygen development, the current efficiencies related to the electrolysis can be increased because the penetration of the ammonium ions through the anion exchange membrane is far less than that of the hydrogen ions.

Since the production of hydrogen ions in association with the oxygen development reaction reduces the current efficiencies of the electrolytic cell, it is sensible to act so that no hydrogen ions are formed in an anode reaction. By selecting appropriate conditions for electrolysis, the oxidation of sulphate ions into peroxodisulphate ions is the main reaction in the anode. The approach is highly advantageous compared with the processes in which oxidation forms the anode reaction.

In U.S. Pat. No. 3,884,778 mentioned above, the anode reaction is the oxidation of sulphate ions but since the anolyte is a solution of highly concentrated sulphuric acid and persulphuric acid, penetration of hydrogen ions through the anion exchange membranes currently produced cannot be avoided. This results in that in a continuous-action process the current efficiency in lye production reduces strongly.

DETAILED DESCRIPTION OF THE INVENTION

Figure 1:
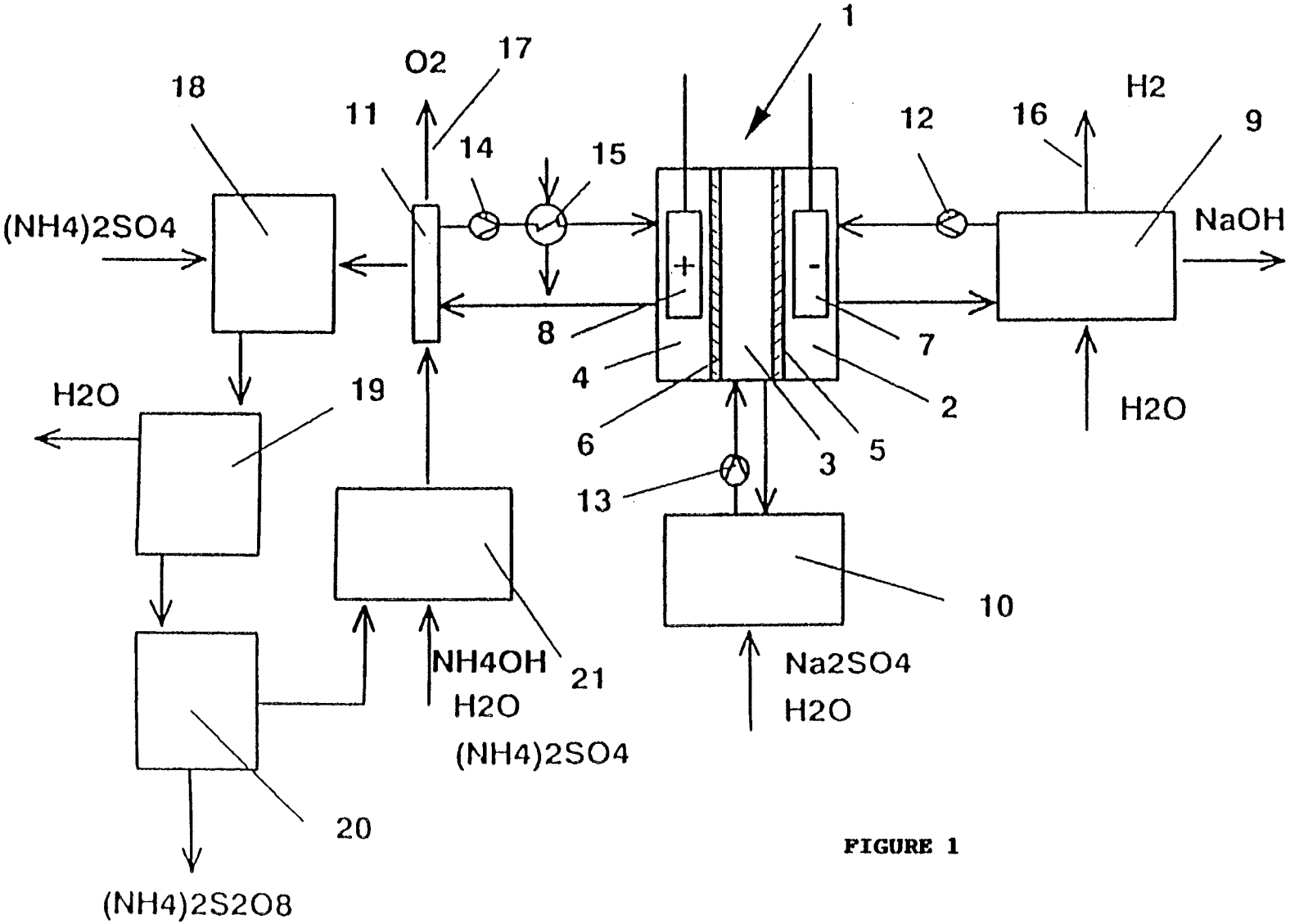
FIG. 1 schematically depicts the method of the present invention for the simultaneous continuous action production of alkali metal or ammonium peroxodisulphate salts and alkali metal hydroxide.

It has been found surprisingly that by combining in one and same three-space electrochemical cell the production of alkali metal or ammonium peroxodisulphate salt as a reaction with an anode and the production of alkali metal hydroxide as a reaction with a cathode, inexpensive alkali metal sulphates, or alkali metal sulphates and ammonium sulphate together can be used for producing said products with the aid of the following total reaction:

$$M_2SO_4(KE)+M'_2SO_4(A)+2H_2O(K)\rightarrow M'_2S_2O_8\text{-}(A)+2MOH(K)+H_2(K)$$

in which M is an alkali metal ion and M' is an ammonium ion or an alkali metal ion. K refers to the cathode space, KE to the middle space and A to the anode space. Preferredly, the method is so carried out that M is a sodium ion and M' ammonium ion, sodium ion or potassic ion. The invention is described below using the instance by way of an example, in which M' is an ammonium ion and M is a sodium ion, but it is to be noted that the sodium ion M can be substituted for another alkali metal ion and the ammonium ion M' for an alkali metal ion.

When the electrolysis is carried out as implied by the invention, it is possible to prepare, in association with the electrolysis of peroxodisulphate salts, also another commercially significant product, that is, alkali metal hydroxide, can be produced at good current efficiency in the same electrolytic cell.

Since in the method according to the invention, the main reaction with the anode is oxidation of sulphate ions and since the anode reaction and the crystallization of the peroxo-disulphate salt thereafter can be performed in solutions in which the content of the hydrogen ion can be very low, the problems related to the poor penetration prevention ability of the hydrogen ion of the anion exchange membranes can be almost entirely avoided.

The preferred feature in the invention is, in addition to the aspects described in the preceding paragraph, the composition of the anolyte used in the electrolytic phase. The dissolved sulphate and peroxodisulphate salts reduce the proportion of the hydrogen ion in transporting the electrical current and at the same time, the leakage thereof through the anion exchange membrane. The leakage of the hydrogen ion remains low although the content thereof in the anolyte might be relatively great.

As described above, the invention concerns a new electrochemical process in which alkali metal hydroxide is simultaneously prepared in association with the production of peroxodisulphate salts in a continuous-action three-space electrolytic cell.

The electrolytic phase of the method according to the present invention is performed in a three-space electrolytic cell (FIG. 1). The electrolytic cell comprises an anode, an anode space, an anode exchange membrane, a middle space, a cation exchange membrane, a cathode space, and a cathode. When direct current is conducted through the electrolytic cell, the sulphate ions supplied into the middle space pass to the anode being thereby oxidized at good current efficiency into peroxodisulphate ions, and the sodium ions supplied into the middle space pass into the cathode space forming lye therein together with the hydroxide ions.

The electrode reactions with anode and cathode can be described as follows:

$$2SO_4^{2-}\rightarrow S_2O_8^{2-}+2e^-\text{(anode)}$$

$$2H_2O+2e^-\rightarrow H_2+2OH^-\text{(cathode)}$$

The lye obtained as a product from the cathode space can be used as such or it may, depending on the purpose, be concentrated by evaporation.

The main product, that is, ammonium peroxodisulphate salt, is obtained by crystallizing it according to the processes known in the art from an anolyte, e.g. in a vacuum crystallizer, before which ammonium sulphate salt can be added in the anolyte. Subsequent to the vacuum crystallization, ammonium sulphate and water are added in the mother solution, and if needed, ammonia water. If needed, sulphuric acid is neutralized with ammonia water from the mother solution discharging from the crystallizer.

In the embodiment of the electrolytic phase according to the invention it is essential that the concentration of the sulphuric acid in the anolyte does not become too high because of the poor hydrogen retention ability of the anion exchange membranes produced with methods known in the art. When sufficient anode current efficiency rate is achieved and when the sulphuric acid content of the input solution in the anode space is low enough, the leakage of the hydrogen ion through the anion exchange membrane is insignificant. The electrolysis is performed so that the concentration of the sulphuric acid in the anolyte will not rise above 3 M. Preferredly, the sulphuric acid concentration is maintained below 1.5 M. The concentration of sulphuric acid can be reduced by adding ammonia water after the crystallization in the solution.

In order to achieve a good peroxodisulphate efficiency, endeavours have been made to prevent the water from being decomposed, this taking place as a side reaction in the anode, whereby oxygen, and hydrogen ions are produced. The proportion of the above side reaction is preferredly minimized in that the sulphate ion concentration in the anolyte is high, the current density in the anode is high, and additives for inhibiting the oxygen formation reaction have been added in the anolyte.

The overall sulphate ion content of the feed solution of the anode space is typically between about 1.5 M and the saturation limit of the solution, preferably over about 2.5 M. For the feed solutions, one sulphate salt, preferably ammonium sulphate, or a variety of sulphate salts can be used, for instance ammonium sulphate and sodium sulphate together, and possibly aqueous solutions containing a little of sulphuric acid.

As an additive inhibiting the oxygen formation reactions, agents increasing the overpotential of the oxygen formation reaction can be used, such as thiocyanate salts, urea, tiourea, or glycine. Preferably, thiocyanate salts are used, for instance ammonium thiocyanate, the preferred concentration whereof being found to vary in the range of about 1 to 25 mM in association with the method of the present invention.

The current density in the anode is about 0.1 to 2 $A/cm^2$, preferredly about 0.2 to 1 $A/cm^2$.

The sodium sulphate solution fed into the middle space of the electrolytic cell must be sufficiently concentrated for minimizing the voltage losses produced in the middle space. The concentration of the feed solution is preferredly in the range 1.5 M and the saturation limit, depending on the operation temperature of the means.

The temperature of the anolyte, controllable with the aid of a heat exchanger external to the cell, must be maintained sufficiently low to prevent the peroxodisulphate ions from decomposing. Typically, the temperature of the anolyte is in the range of about 10° to 40° C., the preferred temperature varying from 20° to 35° C.

For the building material of a filter press type electrolytic cell, both a material resisting the oxidation of peroxodisulphate compounds and lye is used, such as halogenized polymer like PVC, PVDF or Teflon.

For the cathode material, metals known to possess a low hydrogen overpotential are used, not being corroded by the influence of the alkali metal hydroxide. As an example of an appropriate cathode material, nickel may be mentioned.

For the anode material, metals or metal oxides with high oxygen overpotential and resisting corrosion caused by peroxodisulphate ions are used. For the anode of the electrolytic cell a composite structure is appropriate, in which a plate made from valve metal, such as tantalum or titanium plate, is coated with a thin, shiny platinum layer.

An effective mass transfer must be achieved particularly in the middle space among the solution spaces of the filter press type cell, in order to avoid concentration polarisation and voltage losses caused therethrough. A good mass transfer is achieved by means of spacer structures used in prior art electrodialysis cells.

For the anode and cathode spaces, space structures formed by parallel passages can be used. In order to minimize Ohmic voltage losses in the ion exchange membranes of the cell, in different spaces of the cell and in the cathode it is essential that the effective surface areas of said parts are greater than the effective surface area of the anode.

For the cation exchange membrane for use in an electrolytic cell, all membranes preventing selectively the transfer of the hydroxide ions are in general appropriate. Preferred are membranes produced from perfluorized hydrocarbon polymers, in which the cation exchange groups are formed from the sulphonic or carboxylic acid groups, or composite membranes containing both sulphonic or carboxyl acid groups are preferred, though membranes containing sulphonic acid groups only can be regarded as the most preferred alternative.

For the anion exchange membrane, generally speaking all membranes sufficiently retaining ammonium ions and hydrogen ions are appropriate, said membranes resisting sufficiently the oxidizing effect of an electrolyte solution containing peroxodisulphate salts.

FIG. 1 shows schematically a continuous-action electrochemical process according to the present invention for producing peroxodisulphate salts and alkali metal hydroxide.

As in FIG. 1, a three-space electrolytic cell 1 has been divided into a cathode space 2, a middle space 3, and an anode space 4 with the aid of a cation exchange membrane 5 and an anion exchange membrane 6. The cathode 7 is located in the cathode space 2 and the anode 8 in the anode space 4.

In the course of the continuous-action process the cathode space solution of the container 9, the middle space solution of container 10 and the anode space solution of container 11 are circulated in their respective spaces with the aid of pumps 12, 13 and 14. The anolyte can be cooled prior to entry into the anode space 4 with the aid of a heat exchanger 15. The hydrogen gas produced in the cathode reaction is removed via pipe 16 and the oxygen produced to some extent in the anode 8 is separated from the anode space solution with the aid of a pipe 17. When running the electrolysis, water is fed into the catholyte container and as a product an aqueous solution of the alkali metal hydroxide is obtained. Solid sodium sulphate or Glauber salt and water are added in the supply container of the middle space. From the anolyte container 11, anolyte is conducted into a mixing container 18 wherein solid ammonium sulphate can be fed if needed, whereafter the solution enters a crystallizer 19. From the crystallizer 19 a solution containing solid peroxodisulphate salt is conducted into a centrifuge 20, which yields crystalline peroxodisulphate salt as a product. The mother solution left therein is conducted into a mixing container 21 in which the concentrations of the solution are controlled to be appropriate by adding water and ammonium sulphate, and possibly ammonia water.

According to the process diagram, ammonium sulphate, sodium sulphate, ammonium hydroxide and water are preferredly used as starting materials in the process. Sodium sulphate is produced as a byproduct in a great number of processes, of which the production of chloride dioxide and production of viscose fibers may be mentioned as examples.

For main products according the method of the present invention, ammonium or alkali metal peroxodisulphate salt and lye are achieved, and as a byproduct, hydrogen.

EXAMPLES

The electrolysis phase was performed in a three-space electrolytic cell made from PVC. The middle space of the cell was formed by a tortuous path ground in a 3 mm thick PVC plate and provided with turbolence promoters. The anode space and the cathode space of the cell were formed by parallel passages ground in 3 mm thick PVC plates.

For the anode, the effective surface area whereof being 90 $cm^2$, a titanium plate coated with platinum was used, the thickness of said platinum coating being 5 micrometers. For the cathode, the effective surface area whereof being 260 $cm^2$, a nickel plate was used.

For the cation exchange membrane, perfluorized Nafion 324 by Du Pont, containing sulphonic acid groups, was used, and for the anion exchange membrane, ARA 17–10 produced by Morgan. The effective surface areas of the ion exchange membranes were about 200 $cm^2$.

The electrolysis tests were performed as follows: A solution was circulated in a cathode space, ,in which solution diluted sodium hydroxide solution or water was fed and from which concentrated product lye was removed. In the supply space, i.e. the middle space, saturated sodium sulphate solution was circulated. In the solution circulation of the anode space, solutions mentioned in association with the examples were fed, and a solution containing ammonium or sodium peroxodisulphate as a product was removed from the circulation.

The product current of the cathode and anode spaces were sampled from time to time, said samples being thereafter analyzed. From a product of the cathode space the sodium hydroxide concentration was determined, and from a product of the anode space, the peroxodisulphate and hydrogen ion concentrations. From the container of the middle space, the ammonium and hydrogen ion contents were determined from time to time in order to analyze the selectivity of the anion exchange membrane. In addition, the temperatures of the solutions circulating in different spaces were measured in the electrolysis tests. The tests were run so long that the concentrations of the products obtained from the anode space and the cathode space became stable.

The operation of the electrolysis phase was analyzed by measuring the current efficiency of the anode reaction, the selectivity of the anion and cation exchange membranes, and the voltage of the electrolytic cell when the sulphuric acid concentration, ammonium sulphate concentration, temperature and ammonium peroxodisulphate concentration were changed. In addition, the current efficiency of the anode reaction was measured with an aqueous solution of sodium sulphate serving as the anolyte.

Typically, the temperature in the cell varied from 23° C. in the anode space to 35° C. in the cathode space. The product lye in the cathode space was 15 per cent by weight relative to the sodium hydroxide, and the product of the anode space from 0.8 M relative to the peroxodisulphate ion. The value of the electric current in all tests was 52 A, whereby the current density in the anode was 0.58 $A/cm^2$, in the ion exchange membranes about 0.26 $A/cm^2$ and in the cathode 0.20 $A/cm^2$. The lye current efficiency in all tests varied in the range 0.90 and 0.93. The current efficiency related to the formation of peroxodisulphate ions are presented in the tables of the examples. The divergences from the preceding values are mentioned separately in association with different tests.

EXAMPLE 1

The effect of the sulphuric acid concentration of a feed solution of the anolyte was examined on the current efficiency of the anode reaction and on the selectivity of the anion exchange membrane used.

Feed solution of the anode space:

$$2.5\ m(NH_4)_2SO_4 + X\ M\ H_2SO_4 + 5\ mM\ NH_4SCN$$

Table 1. Effect of the sulphuric acid concentration of the feed solution of the anode space on the electrolysis; n(Per) is a current efficiency of the anode reaction and $t_H+$(AM) the transport number of the hydrogen ion in the anion exchange membrane.

| X | n(Per) | $t_H+$ (AM) |
|---|---|---|
| 0.25 | 0.86 | 0.01 |
| 0.55 | 0.85 | 0.07 |
| 1.16 | 0.87 | 0.16 |
| 3.2 | 0.90 | 0.49 |

According to Example 1, a good anode current efficiency is obtained at all sulphuric acid concentrations, whereas leakage of the hydrogen ion through the anion exchange membrane increases vigorously as the sulphuric acid concentration increases above 3 M.

EXAMPLE 2

A test series was performed in which the effect of the ammonium sulphate concentration of a solution fed into the anode space on the current efficiency of the anode reaction and on the leakage of the ammonium ion through the anion exchange membrane used in the tests was tested.

Feed solution of the anode space:

$$X\ M\ (NH_4)_2SO_4 + 0.25\ M\ H_2SO_4 + 5\ mM\ NH_4SCN$$

Table 2. The effect of the ammonium sulphate concentration of the anolyte; n(Per) refers to the current efficiency of the anode reaction, $t_H+$(AM) to the transport number of the hydrogen ion, and $t_{NH4}+$(AM) to the transport number of the ammonium ion in the anion exchange membrane.

| X | n(Per) | $t_H+$ (AM) | $t_{NH4}+$ (AM) |
|---|---|---|---|
| 1.5 | 0.68 | 0.05 | 0.10 |
| 1.75 | 0.75 | 0.01 | 0.13 |
| 2.5 | 0.86 | 0.01 | 0.19 |

According to Example 2, the anode current efficiency at 2.5 M in the ammonium sulphate is extremely good.

EXAMPLE 3

A test series was performed in which the effect of the temperature of the anolyte on the current efficiency of the anode reaction and on the cell voltage was tested.

Feed solution of the anode space:

$$2.5\ M\ (NH_4)_2SO_4 + 0.25\ M\ H_2SO_4 + 5\ mM\ NH_4SCN$$

Table 3. The effect of the temperature of the anolyte; T(AT) refers to temperature of the anolyte, n(Per) to current efficiency of the anode reaction, and U(k) to cell voltage.

| T(AT)/°C. | 18.9 | 27.5 | 34.1 |
|---|---|---|---|
| n(Per) | 0.89 | 0.86 | 0.82 |
| U(k)/V | 7.57 | 7.37 | 6.68 |

On the basis of the results, the anode current efficiency in all tests was good and the effect of temperature on the cell voltage is significant.

EXAMPLE 4

A test series was performed in which the effect of peroxodisulphate ion concentration of the anolyte on the current efficiency of the anode reaction was examined.

Feed solution of the anode space:

$$2.5\ M\ (NH_4)_2SO_4 + 0.25\ M\ H_2SO_4 + 5\ mM\ NH_4SCN$$

Table 4. The effect of the peroxodisulphate concentration of the anolyte on the anode reaction; $c(S_2O^{2-}{}_8)$ refers to the peroxodisulphate ion concentration in the anolyte, and n(Per) to current efficiency of the anode reaction; 1) $c(NH_4SCN) = 10$ mM.

| $c(S_2O^{2-}{}_8)$/M | 0.71 | 0.79 | 1.22 | 1.22 | |
|---|---|---|---|---|---|
| n(Per) | 0.86 | 0.86 | 0.76 | 0.84 | 1) |

As the peroxodisulphate ion concentration increases, the current efficiency decreases, but raising the ammonium thiocyanate concentration in the feed solution the decrease of the current efficiency can be compensated.

EXAMPLE 5

A test series was performed with sodium sulphate containing solutions as the anolyte.

Feed solution of the anode space:

$$X\ M\ Na_2SO_4 + 0.25\ M\ H_2SO_4 + 10\ mM\ NH_4SCN$$

Table 5. Test runs with sodium sulphate containing solutions; n(Per) refers to the current efficiency of the anode reaction, T(AT) to anolyte temperature, and U(k) to cell voltage; 1) $c(NH_4SCN) = 23$ mM.

| X | n(Per) | T(AT)°C. | U(k)V |
|---|---|---|---|
| 1.8 | 0.42 | 23 | 8.2 |
| 2.6 | 0.58 | 32 | 7.4 |
| 2.6 1) | 0.73 | 32 | 7.4 |

Achieving a high current efficiency with sodium sulphate-based solutions is clearly more difficult than with ammonium sulphate-based solutions.

We claim:

1. A method for the simultaneous, continuous-action production of alkali metal or ammonium peroxodisulphate salts and an alkali metal hydroxide, the method comprising the steps of:

conducting an alkali metal sulphate into a middle space of a three space electrolytic cell comprising an anode having an anode space and a cathode having a cathode space wherein the anode is separated from the middle space by an anion exchange membrane and the cathode is separated from the middle space by a cation exchange membrane;

conducting an anolyte comprising a salt selected from the group consisting of: ammonium sulphate, alkali metal sulphate and a mixture thereof, sulfuric acid and an additive into the anode space;

conducting a catholyte selected from the group consisting of: water, diluted alkali metal hydroxide and a mixture thereof, into the cathode space; and passing an electric current between the anode and cathode causing sulphate ions to pass from the middle space to the anode space where the sulphate ions are oxidized into peroxodisulphate ions to produce an alkali metal or ammonium peroxodisulphate and alkali ions to pass from the middle space to the cathode space to form an alkali metal hydroxide.

2. The method of claim 1 wherein the sulphate ion content in the anode space is in the range of about 1.5 M and the saturation limit.

3. The method of claim 1 wherein the concentration of sulfuric acid in the anolyte is below 3 M.

4. The method of claim 1 wherein the current density in the anode is about 0.1 to 2 A/cm$^2$.

5. The method of claim 1 wherein the current density in the anode is about 0.2 to 1 A/cm$^2$.

6. The method of claim 1 wherein sodium sulphate is conducted into the middle space of the cell.

7. The method of claim 6 wherein the concentration of the sodium sulphate is in the range of about 1.5 M.

8. The method of claim 1 wherein the temperature of the anolyte in the anode space is between 10° C. to 40° C.

9. The method of claim 8 wherein the temperature of the anolyte in the anode space is between 20° C. to 35° C.

10. The method of claim 1 wherein the additive is ammonium thiocyanate.

11. The method of claim 10 wherein the amount of ammonium thiocyanate is about 1 to 25 mM.

In the specification, please make the following changes:

12. The method of claim 2 wherein the sulphate ion content in the anode space is over about 2.5 M.

* * * * *

UNITED STATES PATENT AND TRADEMARK OFFICE

CERTIFICATE OF CORRECTION

PATENT NO. : 5,445,717

DATED : August 29, 1995

INVENTOR(S) : Karki et al.

It is certified that error appears in the above-indentified patent and that said Letters Patent is hereby corrected as shown below:

Column 10, line 38,

In claim 5, delete "claim 1" and insert -- claim 4 --.

Inbetween claim 11 and 12, column 10, lines 54-55, please delete "In the specification, please make the following changes: ".

Signed and Sealed this

Thirty-first Day of October 1995

*Attest:*

Bruce Lehman

BRUCE LEHMAN

*Attesting Officer*

*Commissioner of Patents and Trademarks*